United States Patent [19]

Spongh

[11] Patent Number: 4,884,745

[45] Date of Patent: Dec. 5, 1989

[54] METHOD AND APPARATUS FOR INSULATING A SPRAY LIQUID SOURCE FROM HIGH VOLTAGE OF AN ELECTROSTATIC SPRAY GUN

[75] Inventor: Rolf T. Spongh, Tyresö , Sweden

[73] Assignee: Atlas Copco Aktiebolag, Nacka, Sweden

[21] Appl. No.: 25,018

[22] Filed: Mar. 12, 1987

[30] Foreign Application Priority Data

Mar. 17, 1986 [SE] Sweden ..... 8601229-1

[51] Int. Cl.[4] ..... B05B 5/02

[52] U.S. Cl. ..... 239/3; 239/691; 361/228

[58] Field of Search ..... 239/3, 690, 691; 361/227, 228

[56] References Cited

U.S. PATENT DOCUMENTS

| | | | |
|---|---|---|---|
| 3,122,320 | 2/1964 | Beck et al. | 239/3 |
| 3,864,603 | 2/1975 | Kozinski et al. | 239/691 X |
| 3,905,550 | 9/1975 | Rokadia et al. | 239/690 X |
| 3,933,285 | 1/1976 | Wiggins | 222/56 |
| 4,128,871 | 12/1978 | Murad | 361/331 |
| 4,275,834 | 6/1981 | Spanjersberg et al. | 239/691 X |
| 4,629,119 | 12/1986 | Plunkett et al. | 239/690 X |

FOREIGN PATENT DOCUMENTS 3110148 9/1982 Fed. Rep. of Germany .

*Primary Examiner*—Andres Kashnikow

*Attorney, Agent, or Firm*—Frishauf, Holtz, Goodman & Woodward

[57] ABSTRACT

A method and apparatus for insulating a spray liquid source from the high tension voltage of an electrostatic spray gun (13) when using an electrically conductive spray liquid. A spray liquid supply line (12) couples the spray liquid source to the spray gun and comprises an insulating device (14) in the form of a closed vessel (16; 26; 36) containing an electrically non-conductive liquid which is not mixable with the spray liquid and which has a density different from that of the spray liquid. A sprinkler nozzle (21; 31; 41) is arranged to disintegrate the spray liquid into separated drops which are transported through the insulating liquid (17; 27; 35) in the closed vessel at least by the influence of the difference in gravity acting on the two liquids. The separated spray liquid drops form a discontinuation of the electrical lead through which the high tension voltage propagates upstream through the supply line. Thereby, the parts of the supply line upstream of the insulating device, which may include a spray liquid feed pump (11) and a spray liquid receptacle (10), are electrically insulated from the high tension voltage. The closed vessel (26; 36) of the insulating device may comprise passages (27, 28; 37, 38) and a pump (30;40) to forcibly circulate the insulating liquid within the passage in the closed vessel such that a movement is superimposed upon the gravity influenced spray liquid transportation movement to increase the spray liquid flow capacity through the insulating device.

20 Claims, 3 Drawing Sheets

METHOD AND APPARATUS FOR INSULATING A SPRAY LIQUID SOURCE FROM HIGH VOLTAGE OF AN ELECTROSTATIC SPRAY GUN

BACKGROUND OF THE INVENTION

This invention relates to a method and a device for insulating parts of the spray liquid supply line, the spray liquid receptacle, feed pump etc. from the high tension voltage of an electrostatic spray gun when using an electrically conductive liquid spray material such as a water based paint or a paint containing metallic particles.

A previous method and a device for this purpose are disclosed in DE-PS 29 37 890. This prior art device comprises an open receptacle located in the spray material supply line between the spray material source and the electrostatic spray gun. A sprinkler nozzle is arranged to feed the liquid spray material into the receptacle in the form of drops which form a discontinuation of the electrical lead constituted by the spray material in the supply line between the spray gun and the spray material source. This known method and device, however, are disadvantageous in that due to the open receptacle the spray material solvent is free to evaporate into the ambient atmosphere, which causes a change in for instance the viscosity of the spray material. It also means that the spray material feed pump has to be located downstream of the insulating device, thereby being exposed to the high tension voltage led back from the spray gun via the spray material. Accordingly, in the disclosed prior art example, the feed pump drive motor is insulated from the pump by means of a long nonconductive drive shaft.

The object of the present invention is to solve the above problems of the prior art device.

SUMMARY OF THE INVENTION

According to one aspect of the invention, a method for insulating a spray liquid source from a high tension voltage of an electrostatic spray gun when using an electrically conductive spray liquid, comprises supplying the spray liquid to the electrostatic spray gun via a spray liquid supply line means from a spray liquid source arranging in the spray liquid supply line means a volume of a barrier forming liquid which possesses a property of not being mixable with the spray liquid, which has a low electrical conductivity and which has a density different from that of the spray liquid; disintegrating the spray liquid into a great number of small quantities within the barrier forming liquid; and permitting the great number of spray liquid quantities to be transported continuously through the barrier forming liquid at least by the influence of the difference in gravity acting on the two liquids.

According to another aspect of the invention, apparatus for insulating a spray liquid source from a high tension voltage of an electrostatic spray gun when using an electrically conductive spray liquid, comprises supply line means coupling the spray gun to a spray liquid source for supplying an electrically conductive spray liquid to the spray gun; a vessel coupled in the supply line means, the vessel comprising an electically nonconductive material and forming a substantially vertical section of the supply line means, the spray liquid being fed to the vessel; a barrier forming liquid contained in said vessel and possessing a property of not being mixable with the spray liquid, the barrier forming liquid having a low electrical conductivity and a density which is different from that of the spray liquid; and means provided in the vessel for disintegrating the spray liquid fed to the vessel into a great number of small quantities which are passed continuously through the barrier forming liquid at least by the influence of the difference in gravity acting on the two liquids.

DETAILED DESCRIPTION

Figure 1:
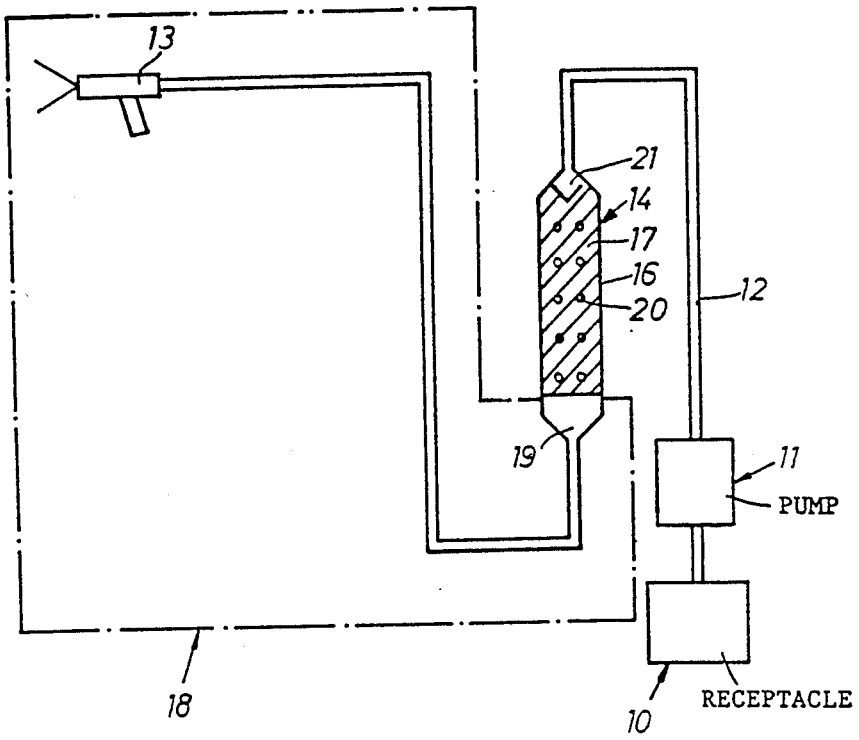
FIG. 1 shows schematically a spray liquid supply system of an electrostatic spray gun including an insulating device according to the invention.
Figure 2:
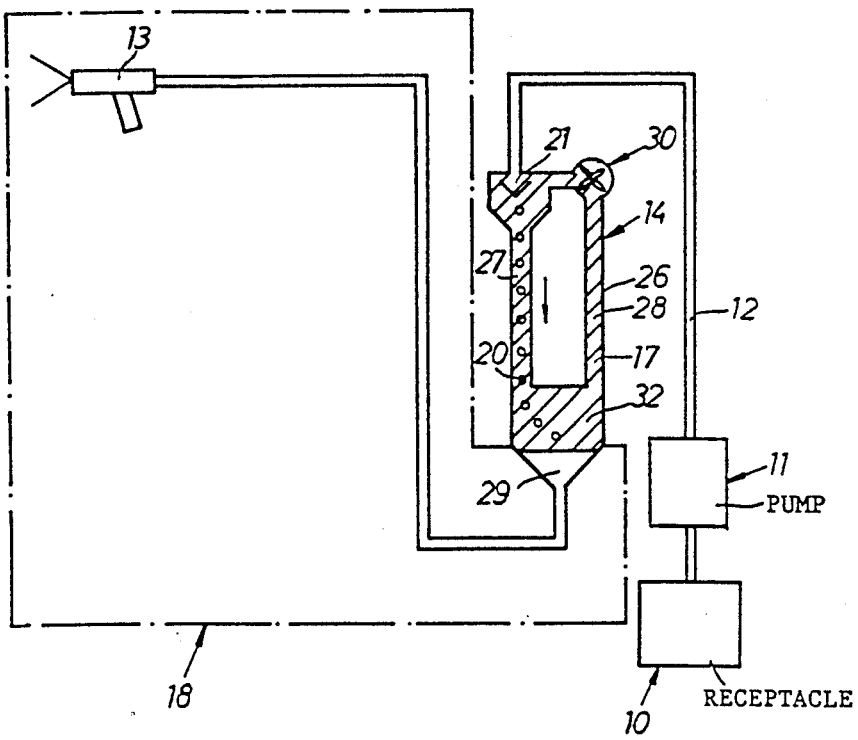
FIG. 2 shows a system similar to that of FIG. 1 but includes an insulating device according to another embodiment of the invention.
Figure 3:
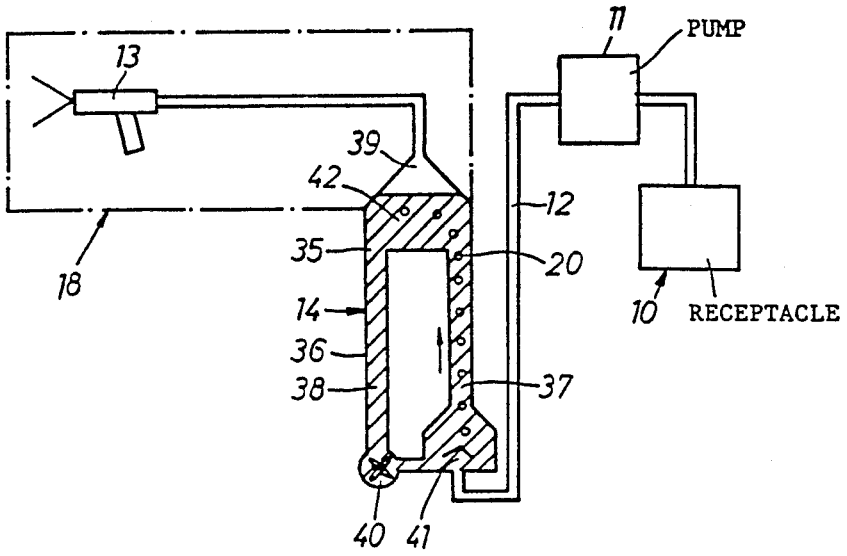
FIG. 3 shows a system similar to that of FIG. 1 but including an insulating device according to still another embodiment of the invention.

Each of the spray liquid supply systems shown in FIGS. 1—3 comprises a receptacle 10 forming the spray liquid source, a feed pump 11, a supply line 12 interconnecting the feed pump 11 and the electrostatic spray gun 13 and an insulating device 14 incorporated in the supply line 12. The insulating device 14 comprises a pressure vessel 16 made of a nonconductive material such as plastics, and contains a substantially nonconductive liquid 17 which has the physical properties of not being mixable with the spray liquid and which has a density that is different from that of the spray liquid. In FIGS. 1 and 2 there are shown two alternative vessel designs each containing a barrier forming liquid 17 which has a lower density than the spray liquid, whereas the vessel shown in FIG. 3 contains a barrier forming liquid 35 which has a higher density than the spray liquid. The vessel shown in FIG. 3 is identical to the vessel shown in FIG. 2 but is located upside-down.

As a barrier forming liquid having a density lower than that of a water based paint, any suitable fraction of petroleum may be used, for example fuel oil which has a density of about 0.8 g/cm$^3$.

Suitable liquids having a higher density than a water based paint are chlorinated hydrocarbons like trichloretan which has a density of 1.43 g/cm$^3$.

In the spray system shown in FIG. 1 a water based liquid paint is supplied from the receptacle 10 to an electrostatic spray gun 13 via a supply line 12 including an insulating device 14. The spray gun 13 is connected to a high tension voltage source (not shown) in order to apply electric charges on the paint being expelled from the gun. The conductive water based paint makes it possible for the high tension potential to propagate upstream through the supply line 12 back to the insulating device 14. This means that the spray gun 13 as well as the supply line 12 downstream of the insulating device 14 are exposed to the high tension voltage and form a high tension section 18 of the system. The electrical lead through the conductive paint is interrupted by the nonconductive barrier forming liquid in the vessel 16. At the top of the vessel 16 there is located a sprinkler nozzle 21 by which the paint is disintegrated into small quantities like drops 20 which are arranged to fall through the insulating liquid 17 by gravity. At the bottom of the vessel 16 the drops gather to form a continuous paint flow through the outlet 19 of the vessel 16. Since the paint is transported through the insulating liquid 17 in the form of separate drops 20 there is no possibility for the high tension voltage to propagate further upstream through the conductive paint. Thereby, the supply line 12 upstream of the insulating device 14 as well as the feed pump 11 and the paint receptacle 10 are effectively protected from the high tension voltage. This means in turn that these upstream parts of the paint supply system may be connected to ground potential and do not need to be built in, for example, a protective booth.

In the paint supply system shown in FIG. 1 the feed pump 11 is located between the paint receptacle 10 and the insulating device 14. Alternatively, the pump 11 may be located downstream of the insulating device 14. In that case, however, the pump 11 would be exposed to the high tension voltage and has to be protected by a grounded insulating cover.

In the paint supply system illustrated in FIG. 2 the insulating device 14 comprises a closed vessel 26 which is divided into two vertically directed passages or ducts 27, 28. The vessel 26 is also provided with a pump 30 for forcibly circulating the barrier forming liquid 17 through these passages 27, 28. One of the passages 27 is disposed with its upstream end just beneath the paint disintegrating sprinkler nozzle 31 and arranged to lead the paint drop carrying insulating liquid downwards toward the paint outlet 29 at the lower end of the vessel 26. This lower part of the vessel 26 forms a discharge section 32 which has a cross sectional area that is several times larger than that of passage 27. This means that the circulation speed of the insulating liquid 17 is several times slower in this part of the vessel 26 than in the passage 27. This enables the paint drops 20 to be safey separated by gravity from the insulating liquid 17 and to be gathered in the discharge section 32 of the vessel 26. Having delivered the paint drops 20 the insulating liquid 17 is circulated upwards from the discharge section 32 through passage 28 and pump 30 and further to sprinkler nozzle 31 and passage 27.

By circulating the insulating liquid as described above, a downward movement is superimposed upon the falling movement of the drops 20 through the insulating liquid, which means that the transportation speed of the paint drops 20 through the vessel 26 is substantially increased, and, accordingly, the paint penetration capacity through the insulating device 14 is increased.

As mentioned above the insulating device 14 of the paint supply system shown in FIG. 3 comprises a vessel 36 in which the insulating barrier forming liquid 35 has a higher density than the paint. This means that the paint due to the difference in gravity seeks to rise through the insulating liquid. Accordingly, the vessel 36 is provided with a paint disintegrating nozzle 41 at its bottom end and a paint outlet 39 at its top end. Further, the vessel 36 comprises two separate vertical passages or ducts 37, 38 and a pump 40 for circulation of the insulating liquid within the vessel 36. As in the embodiment of the invention shown in FIG. 2 the internal circulation of the insulating liquid serves to superimpose a movement upon the gravity related paint drop transportation in order to increase the paint flow through the insulating device. As illustrated in FIG. 3 the pump 40 generates an upward movement of the insulating liquid 35 through passage 37 to increase the paint drop transportation speed from the nozzle 41 to the outlet 39 at the top of the vessel 36. At its outlet end, the vessel 36 comprises a discharge section 42 which has a substantially larger cross section than passage 37 so as to bring down the circulation speed at the discharge section 42 and ensure a safe separation of the paint drops from the insulating liquid 35.

The invention is not limited to the above described examples but may be freely varied within the scope of the claims.

I claim:

1. In an electrostatic spray gun, a method for insulating a spray liquid source from a high tension voltage of the electrostatic spray gun when using an electrically conductive spray liquid supplied from the spray liquid source, comprising:

supplying an electrically conductive spray liquid to the electrostatic spray gun via a spray liquid supply line means from the spray liquid source:

providing in the spray liquid supply line means a volume of a barrier forming liquid which possesses a property of not being mixable with the spray liquid, said barrier forming liquid having a low electrical conductivity and said barrier forming liquid having a low electrical conductivity and a density different from that of the spray liquid;

disintegrating the spray liquid into a great number of small quantities within said barrier forming liquid; and permitting said great number of spray liquid quantities to be transported continuously through said barrier forming liquid by the influence of the difference in gravity acting on said two liquids.

2. The method of claim 1, wherein said barrier forming liquid has a density which is higher than that of the spray liquid, and the spray liquid is transported through said barrier forming liquid in the form of a great number of separated drops which rise through said barrier forming liquid.

3. The method of claim 1, wherein said barrier forming liquid has a density which is lower than that of the spray liquid, and the spray liquid is transported through said barrier forming liquid in the form of a great number of separated drops which fall through said barrier forming liquid.

4. The method of any one of claims 1, 2 or 3, comprising forcibly circulating said barrier forming liquid in a vessel so as to superimpose on said barrier forming liquid a movement in said vessel in the same direction in which said great number of spray liquid quantities is transported through said barrier forming liquid.

5. The method according to claim 1, wherein said spray liquid is disintegrated into separated small quantities.

6. The method according to claim 1, wherein said spray liquid is disintegrated into separated drops.

7. The method of any one of claims 1, 2 or 3, comprising arranging said barrier forming liquid in a vessel located in said supply line.

8. The method of claim 7, wherein said vessel is a closed vessel.

9. In an electrostatic spray gun, apparatus for insulating a spray liquid source from a high tension voltage of the electrostatic spray gun when using an electrically conductive spray liquid supplied from the spray liquid source, comprising:

supply line means (12) coupling the spray gun (13) to the spray liquid source (10) for supplying an electrically conductive spray liquid to said spray gun;

a vessel (16; 26; 36) coupled in said supply line means, said vessel being comprised of an electrically non-conductive material and forming a substantially vertical section of said supply line means, said spray liquid being fed to said vessel via said supply line means;

a barrier forming liquid (17; 27; 35) contained in said vessel (16; 26; 36) and possessing a property of not being mixable with the spray liquid, said barrier forming liquid having a low electrical conductivity and a density which is different from that of the spray liquid; and means (21; 41) provided in said vessel (16; 26; 36) for disintegrating the spray liquid fed to said vessel into a great number of small quantities which are transported continuously through said barrier forming liquid by the influence of the difference in gravity acting on said two liquids.

10. The apparatus of claim 9, wherein said barrier forming liquid has a density which is higher than that of the spray liquid, the spray liquid being transported through said barrier forming liquid in the form of a great number of separated drops which rise through said barrier forming liquid.

11. The apparatus of claim 9, wherein said barrier forming liquid has a density which is lower than that of the spray liquid, the spray liquid being transported through said barrier forming liquid in the form of a great number of separated drops which fall through said barrier forming liquid.

12. The apparatus of any one of claims 9, 10 or 11, comprising means (30; 40) for forcibly circulating said barrier forming liquid (27; 35) within said vessel (26; 36) for superimposing on said barrier forming liquid a movement in the same direction in which said great number of spray liquid quantities are transported through said barrier forming liquid for thereby increasing the spray liquid penetration capacity through said vessel.

13. The apparatus of claim 12, wherein said circulating means comprises a pump coupled to said vessel.

14. The apparatus of claim 9, wherein said vessel (26; 36) comprises:

at least two substantially vertical sections (27, 28; 37, 38) through which said barrier forming liquid is conducted to and from said spray liquid disintegrating means (21; 41); and a discharge section (32; 42) in which the spray liquid is separated from said barrier forming liquid.

15. The apparatus of claims 14, comprising means for forcibly circulating said barrier forming liquid within said vessel for superimposing on said barrier forming liquid a movement in the same direction in which said great number of spray liquid quantities are transported through said barrier forming liquid for thereby increasing the spray liquid penetration capacity through said vessel.

16. The apparatus of claim 9, wherein said supply line means comprises a spray liquid feed pump (11) located upstream of said vessel (16; 26; 36).

17. The apparatus of claim 9, wherein said vessel is a closed vessel.

18. The apparatus of claim 9, wherein said small quantities of said spray liquid are separated drops of said spray liquid.

19. The apparatus of claim 9, wherein said disintegrating means comprises a nozzle means arranged at an entrance portion of said vessel.

20. The apparatus of claim 9, wherein said disintegrating means is arranged at an entrance portion of said vessel.

* * * * *

UNITED STATES PATENT AND TRADEMARK OFFICE

CERTIFICATE OF CORRECTION

PATENT NO. : 4,884,745

DATED : December 5, 1989

INVENTOR(S) : Rolf T. SPONGH

It is certified that error appears in the above-identified patent and that said Letters Patent is hereby corrected as shown below:

Column 4, claim 1, lines 20-21, delete "and said barrier forming liquid having a low electrical conductivity".

Signed and Sealed this

Fourteenth Day of May, 1991

*Attest:*

HARRY F. MANBECK, JR.

*Attesting Officer*

*Commissioner of Patents and Trademarks*